US009394775B2

(12) United States Patent
Rey-Bethbeder et al.

(10) Patent No.: US 9,394,775 B2
(45) **Date of Patent: *Jul. 19, 2016**

(54) ELECTRICAL FRACTURING OF A RESERVOIR

(75) Inventors: Franck Rey-Bethbeder, Lacq (FR); Antoine Jacques, Jurancon (FR); Justin Martin, Pau (FR); Antoine Sylvestre De Ferron, Bernadets (FR); Thierry Reess, Billère (FR); Alain Gibert, Aubertin (FR); Olivier Maurel, Saint Vincent De Tyrosse (FR); Christian Laborderie, Ustaritz (FR); Gilles Pijaudier-Cabot, Ustaritz (FR)

(73) Assignee: TOTAL S.A., Courbevoie (FR)

( * ) Notice: Subject to any disclaimer, the term of this patent is extended or adjusted under 35 U.S.C. 154(b) by 227 days.

This patent is subject to a terminal disclaimer.

(21) Appl. No.: 14/005,171

(22) PCT Filed: Mar. 13, 2012

(86) PCT No.: PCT/EP2012/054398

§ 371 (c)(1),
(2), (4) Date: Sep. 13, 2013

(87) PCT Pub. No.: WO2012/123458

PCT Pub. Date: Sep. 20, 2012

(65) Prior Publication Data

US 2014/0008072 A1 Jan. 9, 2014

(30) Foreign Application Priority Data

Mar. 14, 2011 (FR) ..... 11 52062

(51) Int. Cl.
*E21B 43/26* (2006.01)
*F23Q 3/00* (2006.01)

(Continued)

(52) U.S. Cl.
CPC ..... *E21B 43/26* (2013.01); *E21B 36/04* (2013.01); *E21B 43/003* (2013.01)

(58) Field of Classification Search
CPC ..... E21B 33/00; E21B 43/26
See application file for complete search history.

(56) References Cited

U.S. PATENT DOCUMENTS 2,074,930 A * 3/1937 Marx ..... H01T 11/00 307/107
3,300,682 A * 1/1967 Frank Frungel et al. ..... 315/171

(Continued)

FOREIGN PATENT DOCUMENTS

RU 2349745 C2 3/2009
WO WO-90/13830 A1 11/1990
WO WO-2009/073475 A2 6/2009

OTHER PUBLICATIONS

SurgiFrac (service mark) brochure, Halliburton (2005), available at http://www.halliburton.com/public/pe/contents/data_sheets/web/h/h03392.pdf.*

(Continued)

*Primary Examiner* — Angela M DiTrani
*Assistant Examiner* — Avi Skaist
(74) *Attorney, Agent, or Firm* — Harness, Dickey & Pierce, P.L.C.

(57) ABSTRACT

A device is provided for fracturing a geological hydrocarbon reservoir including two packers defining between them a confined space in a well drilled in the reservoir; a pump for increasing the pressure of a fluid in the confined space; an apparatus for heating the fluid; at least one pair of two electrodes arranged in the confined space; and an electric circuit for generating an electric arc between the two electrodes, the circuit including at least one voltage source connected to the electrodes and an inductance between the voltage source and one of the two electrodes. The device permits improved fracturing of the reservoir.

10 Claims, 8 Drawing Sheets

(51) Int. Cl.

| | |
|---|---|
| ***E21B 36/04*** | (2006.01) |
| ***E21B 43/00*** | (2006.01) |

(56) References Cited

U.S. PATENT DOCUMENTS

| | | | | | |
|---|---|---|---|---|---|
| 3,718,186 | A | * | 2/1973 | Brandon | E21B 43/003 166/248 |
| 4,074,758 | A | | 2/1978 | Scott | |
| 4,164,978 | A | | 8/1979 | Scott | |
| 4,343,356 | A | | 8/1982 | Riggs et al. | |
| 4,345,650 | A | | 8/1982 | Wesley | |
| 4,479,680 | A | * | 10/1984 | Wesley | E21B 43/26 166/249 |
| 4,651,311 | A | | 3/1987 | Owen et al. | |
| 4,667,738 | A | * | 5/1987 | Codina | E21B 43/2401 166/248 |
| 4,706,228 | A | | 11/1987 | Owen et al. | |
| 4,741,405 | A | * | 5/1988 | Moeny | E21B 7/15 175/16 |
| 5,105,097 | A | * | 4/1992 | Rothe | H03K 17/80 307/108 |
| 5,106,164 | A | | 4/1992 | Kitzinger et al. | |
| 5,273,115 | A | * | 12/1993 | Spafford | 166/281 |
| 5,301,169 | A | | 4/1994 | Baria et al. | |
| 6,446,727 | B1 | * | 9/2002 | Zemlak et al. | 166/308.1 |
| 8,061,424 | B2 | | 11/2011 | Willberg et al. | |
| 8,220,537 | B2 | | 7/2012 | Leon et al. | |
| 8,327,952 | B2 | | 12/2012 | Amadei et al. | |
| 2004/0060735 | A1 | | 4/2004 | Beckman | |
| 2007/0137893 | A1 | * | 6/2007 | Moeny | B23H 1/08 175/1 |
| 2008/0036301 | A1 | * | 2/2008 | McDonald | H03K 3/57 307/108 |
| 2009/0044945 | A1 | | 2/2009 | Willberg et al. | |
| 2009/0173492 | A1 | | 7/2009 | O'Malley | |
| 2009/0294121 | A1 | | 12/2009 | Leon et al. | |
| 2011/0011592 | A1 | | 1/2011 | Leon et al. | |
| 2012/0279713 | A1 | | 11/2012 | Leon et al. | |

OTHER PUBLICATIONS

Soeder, Daniel J., "Porosity and Permeability of Eastern Devonian Gas Shale," SPE Formation Evaluation, Mar. 1988, vol. 3, No. 1, pp. 116-124.

International Search Report and Written Opinion of the ISA for PCT/EP2012/054392, ISA/EP, Rijswijk, NL, mailed Oct. 29, 2012.

* cited by examiner

ELECTRICAL FRACTURING OF A RESERVOIR

CROSS-REFERENCE TO RELATED APPLICATIONS

This application is a National Phase Entry of International Application No. PCT/EP2012/054398, filed on Mar. 13, 2012, which claims priority to French Patent Application Serial No. 1152062, filed on Mar. 14, 2011, both of which are incorporated by reference herein.

BACKGROUND AND SUMMARY

The present invention relates to a device and a method for fracturing a geological hydrocarbon reservoir, as well as a method of production of hydrocarbons.

In the production of hydrocarbons, the permeability and/or the porosity of the material constituting the reservoir have an influence on the production of hydrocarbons, in particular on the rate of production and thus the profitability. This is in particular what is referred to in the article "Porosity and permeability of Eastern Devonian Shale gas" by Soeder, D. J., published in SPE Formation Evaluation, 1988, Vol. 3, No. 1, pp. 116-124, which describes the investigation of eight samples of Devonian shale gas, originating from the Appalachians. In particular, this article explains that the production of this shale gas presents the difficulty that the reservoir (i.e. the material constituting the reservoir) has low permeability.

Thus, various techniques exist for facilitating the rate of production of hydrocarbons, in particular from a reservoir of low permeability and of low porosity. These techniques consist of fracturing the reservoir statically or dynamically.

Static fracturing is a targeted dislocation of the reservoir, by injecting a fluid under very high pressure to crack the rock. Cracking is effected by a mechanical "stress" originating from hydraulic pressure obtained by means of a fluid injected under high pressure from a well drilled from the surface. It is also called "hydrofracturing" or "hydrosiliceous fracturing" (or else "frac jobs", or more generally "fracking", or "massive hydraulic fracturing"). Document US 2009/044945 A1 in particular presents a method of static fracturing as described above.

Static fracturing has the drawback that the fracturing of the reservoir is generally unidirectional. Thus, only the hydrocarbon present in the portion of the reservoir around a deep but highly localized crack is produced more quickly.

To obtain more diffuse fracturing, dynamic fracturing, or electrical fracturing, has been introduced. Electrical fracturing consists of generating an electric arc in a well drilled in the reservoir (typically the production well). The electric arc induces a pressure wave which damages the reservoir in all directions around the wave and thus increases its permeability.

Several documents discuss electrical fracturing. For example, document U.S. Pat. No. 4,074,758 presents a method consisting of generating an electro-hydraulic shock wave in a liquid in the wellbore to improve petroleum recovery. Document U.S. Pat. No. 4,164,978 suggests following the shock wave with an ultrasonic wave. Document U.S. Pat. No. 5,106,164 also describes a method of generating a plasma blast and thus fracturing a rock, but in the case of a borehole of small depth, for a mining application and not for production of hydrocarbons. Documents U.S. Pat. No. 4,651,311 and U.S. Pat. No. 4,706,228 present a device for generating an electric discharge with electrodes in a chamber containing an electrolyte, in which the electrodes are not subject to erosion by the plasma of the discharge. Document WO 2009/073475 describes a method of generating an acoustic wave in a fluid medium present in a well with a device comprising two electrodes between an upper packer and a lower packer defining a confined space. According to this document, the acoustic wave is maintained in a non-"shock wave" state in order to improve the damage, without however explaining the differences between "ordinary" acoustic wave and "shock" wave.

None of these documents produces entirely satisfactory fracturing of the reservoir. There is therefore a need for improved fracturing of a hydrocarbon reservoir.

For this, a device is proposed for fracturing a geological hydrocarbon reservoir, in which the device comprises two packers that between them define a confined space in a well drilled in the reservoir; a pump for increasing the pressure of a fluid in the confined space; an apparatus for heating the fluid; at least one pair of two electrodes arranged in the confined space; and an electric circuit for generating an electric arc between the two electrodes, the circuit comprising at least one voltage source connected to the electrodes and an inductance between the voltage source and one of the two electrodes. According to examples, the device can comprise one or more of the following features:

- the inductance is an adjustable inductance coil, preferably between 1 μH and 100 mH, more preferably between 10 μH and 1 mH;
- the distance between the electrodes is adjustable, preferably between 0.2 and 5 cm, more preferably between 1 and 3 cm;
- the voltage source comprises a capacitor with a capacitance above 1 μF, preferably above 10 μF;
- the capacitance of the capacitor is adjustable, preferably below 1000 μF, more preferably below 200 μF;
- the circuit further comprises a Marx generator and ferrites forming a saturable inductance in a path leading the capacitor directly to the inductance, the ferrites being saturated once the Marx generator has discharged;
- the capacitor is separated from the inductance by a spark-gap that can be triggered by a pulse generator;
- the voltage source comprises a Marx generator (118), said Marx generator preferably having adjustable characteristics;
- the electrodes have a radius between 0.1 mm and 50 mm, preferably between 1 mm and 30 mm;
- the device is mobile and is fixed before generating an electric arc;
- the device comprises an uncoupling system;
- the device comprises several pairs of electrodes.

A method is also proposed for fracturing a geological hydrocarbon reservoir, in which said method comprises electrical fracturing of the reservoir by generating an electric arc in a fluid present in a well drilled in the reservoir, the electric arc inducing a pressure wave the rise time of which is greater than 0.1 μs, preferably greater than 10 μs. According to examples, the method can comprise one or more of the following features:

- the arc is generated by the device described above;
- the voltage source is charged by a high-voltage charger to a voltage between 1 and 500 kV, preferably between 50 and 200 kV;
- the method further comprises static fracturing of the reservoir by hydraulic pressure, preferably the static fracturing precedes the electrical fracturing;
- the well is horizontal;
- electrical fracturing is repeated in various treatment zones along the well and/or in which several arcs are generated in succession in each treatment zone.

A method is also proposed for the production of hydrocarbons comprising the fracturing of a geological hydrocarbon reservoir by the method described above.

BRIEF DESCRIPTION OF THE FIGURES

Other features and advantages of the invention will become apparent on reading the following detailed description of the embodiments of the invention, given solely by way of example and with reference to the drawings which show.

DETAILED DESCRIPTION

Figure 1:
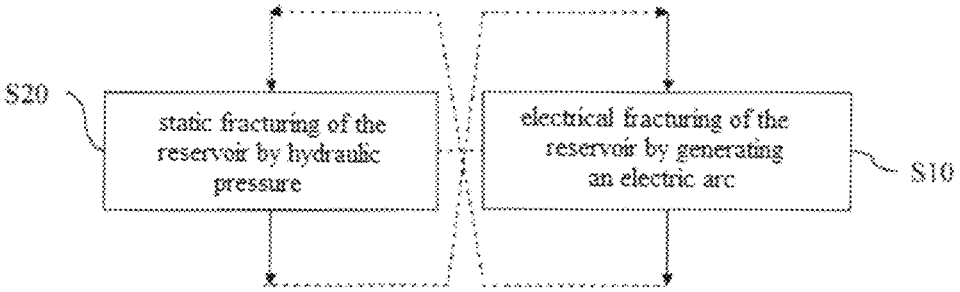
FIGS. 1 to 3, schematic diagrams showing proposed methods of fracturing.

With reference to FIG. 1, a method is proposed for fracturing a geological hydrocarbon reservoir. The method in FIG. 1 comprises static fracturing (S20) of the reservoir by hydraulic pressure. And the method in FIG. 1 also comprises, before, during or after the static fracturing (S20) (these three possibilities being represented by the dotted lines in FIG. 1), electrical fracturing (S10) of the reservoir by generating an electric arc in a well drilled in the reservoir. The method in FIG. 1 improves the fracturing of the reservoir.

The expression "electric arc" denotes an electric current created in an insulating medium. The generation of the electric arc induces a "pressure wave", i.e. a mechanical wave causing, in its passage, a pressure to be exerted on the medium through which the wave passes. Generation of the electric arc leads to damage of the reservoir that is more diffuse/multidirectional than the damage resulting from static fracturing. Generation of the electric arc thus leads to microcracks in all directions around the position of the electric arc, and thus increases the permeability of the reservoir, typically by a factor of 10 to 1000. Moreover, this increase in permeability occurs without using a means for preventing closure of the microcracks, such as injection of propping agent. Moreover, electrical fracturing (S10) does not require large quantities of energy or excessive quantities of water. Therefore there is no need for a specific water recycling system.

Access can thus be gained to hydrocarbon present in the reservoir that is not easily available by static fracturing. The combination of static fracturing (S20) and electrical fracturing (S10) therefore permits better overall fracturing of the reservoir.

The electric arc is preferably generated in a fluid present in a well drilled in the reservoir. The pressure wave from the electric arc is thus transmitted with less attenuation. The drilled well contains fluid, which is typically water. In other words, when electrical fracturing (S10) follows a drilling operation, the drilled well can be filled automatically with water present in the reservoir. Potentially, if the drilled well does not fill automatically, it can be filled artificially.

The static fracturing (S20) can be any type of static fracturing known from the prior art. In general, the static fracturing (S20) can comprise, after optional drilling of a well in the reservoir, injection of a fluid under high pressure into the well. The static fracturing (S20) thus creates one or more unidirectional cracks, typically deeper than those created by electrical fracturing (S10). The fluid can be water, a mud or a technical fluid with controlled viscosity enriched with hard agents (grains of sieved sand, or ceramic microbeads) which prevent the fracture network closing on itself when the pressure drops.

Static fracturing (S20) can comprise a first phase of injecting, into a drilled well, a fracturing fluid which contains thickeners, and a second phase that involves periodical introduction of propping agent (i.e. a supporting agent) in the fracturing fluid, to supply propping agent to the fracture created. Thus, clusters of propping agent are formed in the fracture, which prevent the latter closing again and supply channels for the flow of the hydrocarbon between the clusters. The second phase or its sub-phases involve additional introduction of a reinforcing and/or consolidating material, thus increasing the force of the clusters of propping agent formed in the fracturing fluid. Said static fracturing (S20) makes it possible to obtain fractures typically between 100 and 5000 meters.

Static fracturing (S20) can precede electrical fracturing (S10). In such a case, the pressure wave generated by the electrical fracturing (S10) can follow the course of the fluid introduced into the cracks created by the static fracturing (S20) and thus increase the damage. Moreover, with this order of fracturing (S20) and (S10), there is little risk of leaks. For example, static fracturing (S20) can precede electrical fracturing (S10) by less than a week.

Figure 2:
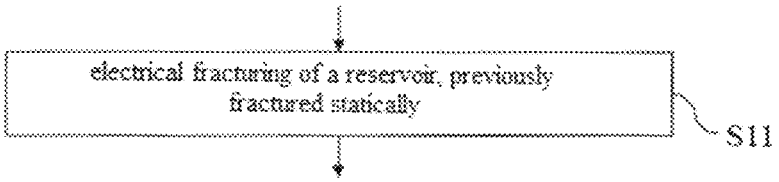

With reference to FIG. 2, a method is also proposed for fracturing a geological hydrocarbon reservoir previously fractured statically by hydraulic pressure. The method in FIG. 2 then only comprises electrical fracturing (S11) of the reservoir, carried out in a reservoir where one well has already been drilled and has already been fractured statically. The method in FIG. 2 provides damage of reservoirs already exploited after static fracturing. In other words, the method in FIG. 2 allows exploitation of a reservoir that has been abandoned as it has already been exploited, potentially by reusing a well already drilled. It should be noted that if it is combined with this previous static fracturing, the method in FIG. 2 corresponds to the method in FIG. 1 (where the static fracturing (S20) corresponds to this previous static fracturing). Thus, the previous static fracturing can have been carried out according to the method in FIG. 1.

Figure 3:
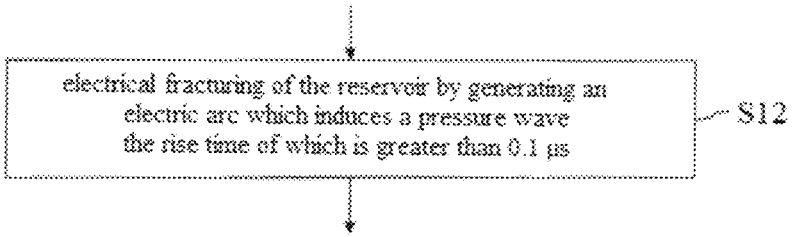

With reference to FIG. 3, a method is proposed for fracturing a geological hydrocarbon reservoir comprising specific electrical fracturing (S12). The electrical fracturing (S12) proposed in the method in FIG. 3 can of course be used in the method in FIG. 1 and/or in the method in FIG. 2. The method in FIG. 3 mainly comprises electrical fracturing (S12) of the reservoir by generating an electric arc in a fluid present in a well drilled in the reservoir (therefore combined or not with static fracturing, for example the static fracturing (S20) of the method in FIG. 1). The electric arc induces a pressure wave the rise time of which is greater than 0.1 μs, preferably greater than 10 μs. The method in FIG. 3 improves the fracturing of the reservoir.

The rise time of the pressure wave is the time taken for the pressure wave to reach the peak pressure, i.e. the maximum value of the wave (also called "surge pressure"). In this case, a rise time greater than 0.1 μs, preferably greater than 10 μs, corresponds to a pressure wave with better penetration into the reservoir. Such a pressure wave is particularly effective (i.e. the wave penetrates more deeply) in the case of materials of low ductility, such as those of which the shale gas reservoirs are composed. Preferably, the rise time is less than 1 ms, advantageously less than 500 μs.

The pressure wave can have a maximum pressure of up to 10 kbar, preferably above 100 bar and/or below 1000 bar. This can correspond to a stored energy between 10 J and 2 MJ, preferably between 10 kJ and 500 kJ.

Various possibilities applicable to any one of the methods in FIG. 1, FIG. 2 or FIG. 3 will now be described. The well can be horizontal. For example, the well can be horizontal and can have a length preferably between 500 and 5000 m, advantageously between 800 and 1200 m, for example at a depth between 1000 and 10000 m, for example between 3000 and 5000 m.

Electrical fracturing (S10, S11, S12) can be repeated in various treatment zones along the well. In fact, with electrical fracturing (S10, S11, S12), the pressure wave generally penetrates less deeply than in static fracturing. Thus, with electrical fracturing (S10, S11, S12) cracks are typically obtained with a length less than 100 m, typically less than 50 m, and typically greater than 20 m. For a well of several hundred meters, repetition of electrical fracturing (S10, S11, S12) along the well permits damage all along the well and therefore possibly better exploitation of the reservoir.

Moreover, in each treatment zone (or in the single treatment zone if there is only one), several arcs can be generated in succession. Here, generation of an electric arc is repeated in a more or less fixed position. The damage is thus increased by repeating the pressure wave. The arcs generated can be the same or can be different. For example, in each treatment zone, the arcs generated in succession induce a pressure wave the rise time of which is decreasing. For example, the successive arcs can have a more and more rigid front, thus inducing a pressure wave having a faster and faster rise time. In such a case, the first pulses have slower fronts for penetrating deeply, whereas the pulses with the more rigid fronts fracture nearer the well and more densely. The damage is thus optimized. The first arcs can for example induce a pressure wave the rise time of which is greater than 10 μs, preferably 100 μs. The last arcs can then induce a pressure wave the rise time of which is less than the rise time of the first arcs, for example below 10 μs or 100 μs. The first arcs comprise at least one arc, preferably a number below 10000 or even 1000, and the last arcs comprise at least one arc, preferably a number below 10000 or even 1000.

Moreover, in each treatment zone, the arcs can be generated at a frequency below 100 Hz, preferably below 10 Hz, and/or above 0.001 Hz, preferably above 0.01 Hz. Preferably, the frequency of the arcs can be (approximately) equal to the resonance frequency of the material to be fractured in the reservoir. This ensures more effective damage.

The reservoir can have a permeability below 10 microdarcy. It can in particular be a shale gas reservoir. In reservoirs of this type, the gas is typically adsorbed (up to 85% on Lewis Shale) and weakly trapped in the pores. The low permeability of this type of reservoir means we cannot expect the gases trapped in such a medium to be produced directly, only the surface gas (adsorbed gas) can be produced. Thus, for a shale gas reservoir where the permeability is of the microdarcy order, electrical fracturing (S10) that is effective over a radius of 30 m along a horizontal well of 1000 m would permit gas recovery that can exceed 50 $MNm^3$ (if we assume 26 $Nm^3$ of gas per $m^3$ of rock as suggested in the article "Porosity and permeability of Eastern Devonian Shale gas" cited above). The method of fracturing in any one of FIGS. 1 to 3 can thus be included in a method of production of hydrocarbons from the reservoir, typically a shale gas reservoir.

Generation of the electric arc can induce a temperature gradient generating a pressure wave in the fluid. Electrical fracturing (S10) can comprise first injecting the fluid with an agent for improving the plasticity of the material constituting the reservoir. The agent can comprise a chemical additive. The chemical additive can be an agent inducing rock fracture. The additive can comprise steam. This allows further improvement in fracturing.

An example of electrical fracturing (S10, S11, S12) of the method of fracturing in any one of FIGS. 1 to 3 will now be described, with reference to FIGS. 4 to 6. In this example, electrical fracturing (S10, S11, S12) is carried out on a reservoir 40 in which a horizontal well 43 has been drilled. Electrical fracturing (S10, S11, S12) is in this instance combined with static fracturing, not specifically shown and optionally preliminary, which induced main fractures 41 in the reservoir. The fracturing method makes it possible in this case to produce hydrocarbon by means of a production pipe located at the surface, at the well head 45. The electric arc is in this instance generated at the level of a fracturing device 47.

Figure 4:
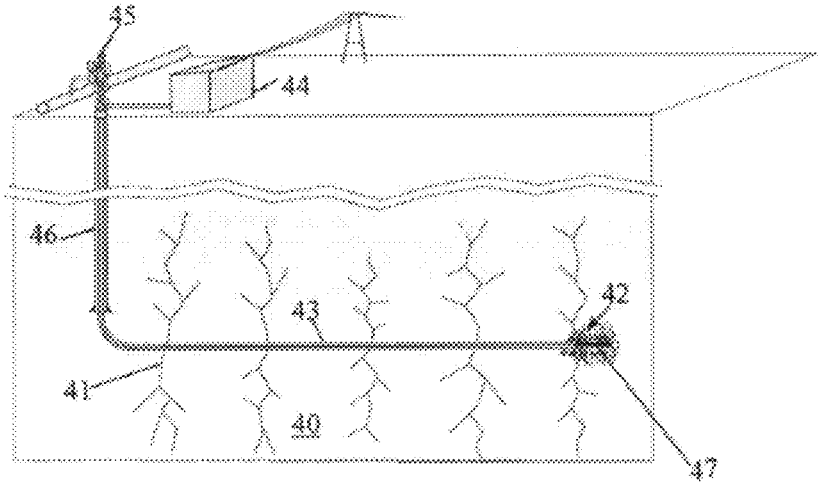
FIGS. 4 to 6, an example of the electrical fracturing of the method of fracturing in any one of FIGS. 1 to 3.
Figure 5:
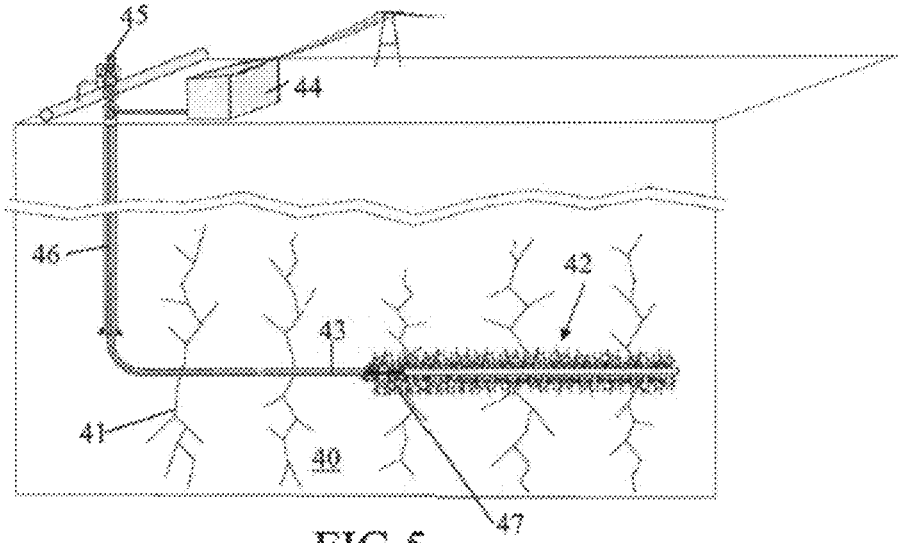
Figure 6:
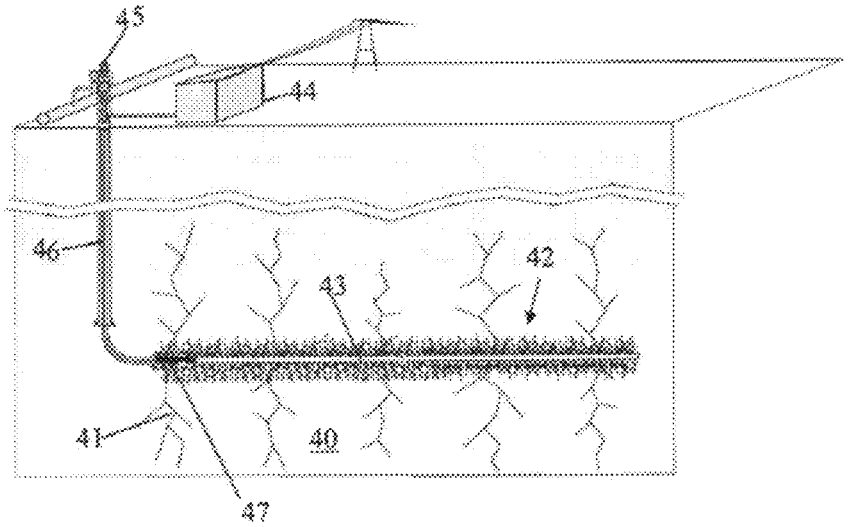

In the example in FIGS. 4 to 6, electrical fracturing (S10, S11, S12) induces secondary fractures 42 at the level of the place where the arc is generated. In the example, the secondary fractures 42 are not as long but are more diffuse than the main fractures 41. In this example, electrical fracturing (S10, S11, S12) is repeated in various treatment zones along the well. FIG. 4 shows in fact an initial phase of electrical fracturing (S10, S11, S12) at well bottom. FIG. 5 shows an intermediate phase in the middle of the well. And FIG. 6 shows a final phase at the start of the well. Progression of the secondary fractures 42 during repetition of electrical fracturing is thus observed. Thus, the secondary fractures 42 are dispersed all around the well 43. The hydrocarbon surrounding these secondary fractures 42 can then be recovered, said hydrocarbon potentially being remote from the main fractures 41 and therefore difficult to recover by static fracturing alone.

In general, the electric arc of the method in any one of FIG. 1 to 3 or 4 to 6 can be generated by any device provided for generating said arc. However, a specific device for generating the arc will now be described. It will be understood that the various functionalities of the specific device (i.e. the various effects that it can produce) can be integrated in the method in any one of FIGS. 1 to 3, in particular in the electrical fracturing S10 of the method.

The specific device for fracturing a geological hydrocarbon reservoir comprises two packers that between them define a confined space in a well drilled in the reservoir (i.e. provided in order to be confined at least when the specific device is installed in a well drilled in the reservoir), and an electric circuit (configured/adapted/provided) for generating an electric arc between two electrodes arranged in the confined space. The circuit comprises at least one voltage source connected to the electrodes and an inductance between the voltage source and one of the two electrodes. The device also comprises a pump for increasing the pressure of a fluid in the confined space and an apparatus for heating the fluid. The specific device improves the fracturing of the reservoir.

The packers can be provided for conforming to the wall of the well, generally cylindrical, thus defining a confined space between them. Alternatively, or additionally, the device can comprise a membrane that delimits the confined space. The membrane is then preferably made of a material suitable for the good conduction of pressure waves, which optimizes the electrical fracturing (S10, S11, S12). By "confined" is meant that the confined space is provided so that the pressure and temperature prevailing there can be altered by means of a pump and heating apparatus, as is known to a person skilled in the art. This makes it possible to optimize the fluid present in the confined space in order to promote the production of an electric arc between the two electrodes, as a function of the conditions of the reservoir or the nature of the fluid. For example, increasing the temperature at constant pressure generally facilitates the production of an electric arc. Thus, "confining" can but does not necessarily signify complete closure, and similarly, the seal can be but is not necessarily total.

The circuit comprises at least one inductance between the voltage source and the electrode to which it is connected. The inductance can be any component that induces a time delay in the current with respect to the voltage. The value of an inductance is expressed in henry units. The inductance can thus be a coil, optionally wound round a core of ferromagnetic material, or ferrites. The inductance is also known by the names "choke", "solenoid" when it is a coil, or "self-inductance". The inductance attenuates the current front in the circuit. This makes it possible to obtain a slower rise time of the pressure wave, and therefore a pressure wave with better penetration into the reservoir. The damage to the reservoir is thus deeper. In particular, the inductance can be above 1 μH or above 10 μH, and/or below 100 mH or below 1 mH.

The device can be movable along the well and can be fixed before generating an electric arc. For example, the device can comprise means for movement, e.g. by remote control. This allows the device to be adapted in particular to the method of fracturing in FIGS. 4 to 6, with the advantages flowing from this. The device can then be supplied by a high-voltage supply located on the surface and connected to the device by electric cables along the well. (In fact, in the example in FIGS. 4 to 6, the mobility of the fracturing device 47, which can be the specific device, makes it possible to fracture the reservoir all the way along the well. The device 47 is supplied in this example by a high-voltage supply 44 located on the surface and connected to the device 47 by the cables 46.) The device can then also comprise an uncoupling system. This makes it possible to leave the device in the well when the latter is blocked. Then the well and/or the string of rods can be recovered.

The device can be of elongated general shape, which makes it easier to move it in the well. The device can also comprise several pairs of electrodes, over one length. The electrodes can be supplied by several storage capacitors. This makes it possible to perform fracturing more quickly. In fact, several electric arcs can then be generated at the same time between each pair of electrodes, and several damaging operations can be carried out at the same time.

The device can comprise a system for injecting a chemical additive that includes a storage tank for storing the additive and a pump, for injecting the additive into the confined space, when the device is used. The heating apparatus can comprise a source of hot fluid and a conveying conduit, the conduit having an opening near the electrodes so that, during operation of the device, hot fluid can be conveyed from the source to the electrodes so as to create a thermal gradient between the electrodes. The conveying conduit can pass through one or both electrodes. These various features make it possible to optimize the conditions to promote the production of an electric arc.

Other potential features of the specific device for fracturing a geological hydrocarbon reservoir will now be presented, with reference to FIGS. 7 to 10, which show a device 100, constituting an example of the specific device for fracturing a geological hydrocarbon reservoir presented above. The device 100 in FIG. 7 comprises the two packers 102 and 103 defining the confined space 104 between them. The confined space 104 is in this instance further delimited by the membrane 108. The device 100 also comprises the two electrodes 106 arranged in the confined space 104. In the example, the two electrodes 106 are connected respectively to the voltage source by an input 109 and to an earth 107 (in this case combined with the packer 103) of the circuit, which allows formation of the electric arc between the two electrodes 106. The electrodes can have a radius between 0.1 mm and 50 mm, preferably between 1 mm and 30 mm.

Figure 7:
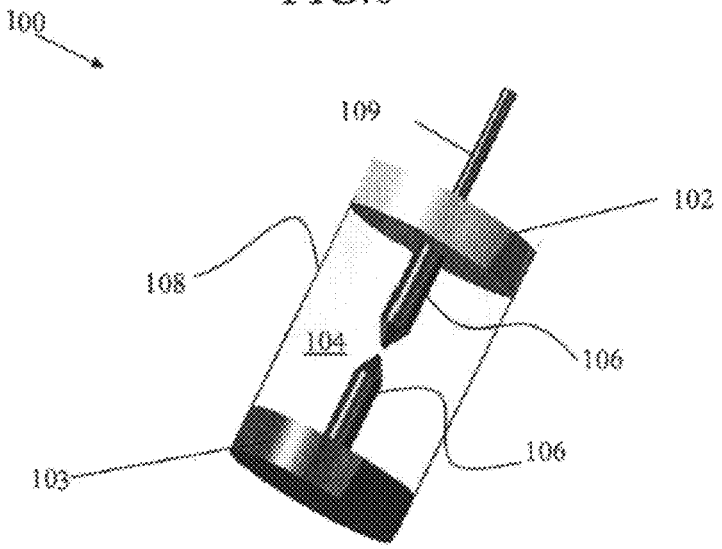
FIGS. 7 to 10, examples of a specific device for generating an electric arc.

The pump for increasing the pressure of a fluid in the confined space and the apparatus for heating the fluid are not shown in FIG. 7. The electric circuit for generating an electric arc between the two electrodes 106, its voltage source and inductance are not shown either, but can conform to FIGS. 8 to 10, which show diagrammatically examples of the device 100.

Figure 8:
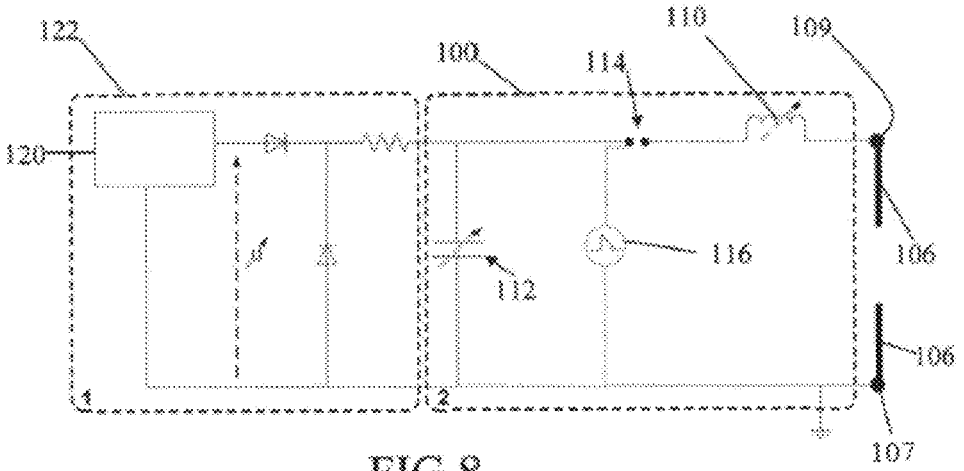

The device 100 in FIG. 8 comprises the inductance coil 110. The voltage source comprises the capacitor 112. As can be seen in the schematic diagram in FIG. 8, when the capacitor 112 discharges, an electric arc can appear between the electrodes 106. The capacitor 112 can have a capacitance above 1 μF, preferably above 10 μF. This capacitance makes it possible to reach an energy value leading to the appearance of a subsonic arc.

An electric arc is called "subsonic" or "supersonic" depending on its velocity. A "subsonic" arc is typically associated with thermal processes: the arc is propagated through gas bubbles created by heating the water. Reference is made to "slow" propagation of the electric discharge, typically of the order of 10 m/s. The main characteristics of a subsonic discharge are connected with high energies involved (typically above several hundred joules), with thermal processes associated with a long voltage application time and with low voltage levels (weak electric field). In this discharge regime, the pressure wave is propagated in a large volume of gas before being propagated in the fluid. A "supersonic" arc is typically associated with electronic processes. The discharge is propagated in the water without a thermal process with a filamentary appearance. Reference is made to "rapid" propagation of the electric discharge, of the order of 10 km/s. The characteristics of a supersonic discharge are connected with low energies involved, with high voltages associated with a short application time and with strong electric fields (MV/cm). For this discharge regime, the thermal effects are negligible. Since the discharge cannot develop directly in the liquid phase, the concept of micro-bubbles can be taken into account in order to explain the development of this discharge regime. The volume of gas involved is less than in the case of subsonic discharges.

The capacitor 112 can have a capacitance below 1000 μF, preferably below 200 μF. The capacitor 112 is separated from the inductance by the spark gap 114, which can be triggered by the pulse generator 116. This makes it possible to control the discharges of the capacitor 112 and thus the pressure waves generated by the electric arc. In particular, the pulse generator 116 can be configured for repetition of the waves as described above. The voltage source (i.e. the capacitor 112) is charged by a high-voltage charger 120 provided in an auxiliary circuit 122 to a voltage U between 1 and 500 kV, preferably between 50 and 200 kV. The auxiliary circuit is preferably located on the surface, and is then separable from the device.

Figure 9:
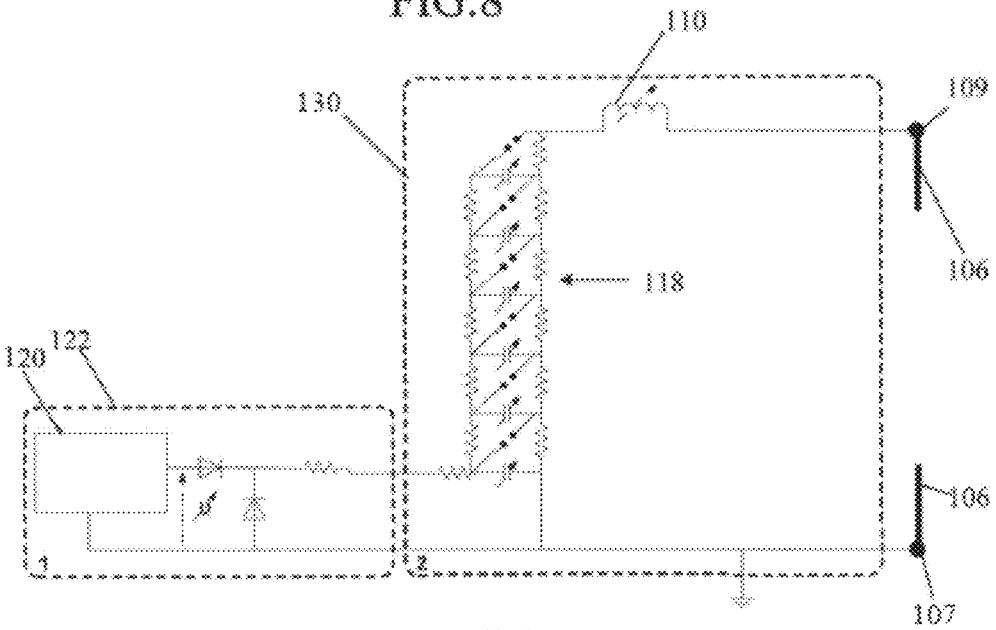

The device 130 in FIG. 9 is different from the example in FIG. 8 in that a Marx generator 118 replaces the capacitor 112 and the assembly (spark gap 114+pulse generator 116). The Marx generator 118 makes possible, when it discharges, the creation of a supersonic electronic arc, by imposing a voltage higher than the capacitor 112.

Figure 10:
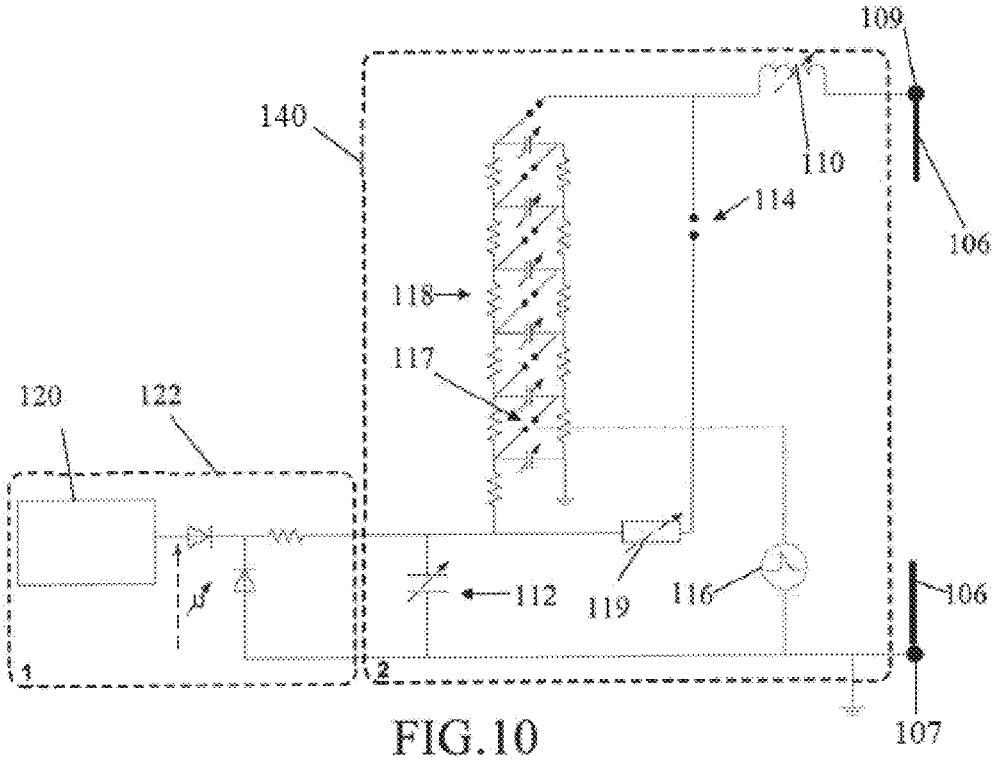

In the device 140 in FIG. 10, the voltage source comprises the capacitor 112 from FIG. 8 and the Marx generator 118 from FIG. 9. However, the pulse generator 116 triggers the first spark gap 117 of the Marx generator 118. The device 140 further comprises the ferrites 119 forming a saturable inductance in a path leading the capacitor directly to the inductance. The ferrites 119 are configured to be saturated once the Marx generator 118 has discharged. Once the ferrites 119 are saturated, only the capacitor 112 discharges. This permits temporary isolation of the capacitor 112 and therefore passage (i.e. switching) from a supersonic arc to a subsonic arc. The device therefore provides coupling between a supersonic and a subsonic discharge. Such a combination of the two modes, supersonic and subsonic, gives better electro-acoustic efficiency, and therefore better damage for less electrical effort. As for the subsonic discharge produced by the capacitor 112, it occurs after a delay corresponding to the breakdown time of the Marx generator 118. Switching can take less than 1 s. Typically, the duration of the discharge produced by the Marx generator 118 is very short, with a duration of less than 1 microsecond, and with an amplitude greater than 100 kV.

In the three examples in FIGS. 8 to 10, and as indicated by the figures, the various components of the device 100, 130, 140 have adjustable characteristics, i.e. their characteristics can be altered before use as a function of the reservoir, or during use as a function of the response or the progress of the fracturing. Thus, coil 110 can have adjustable inductance. The characteristics of the Marx generator 118 (capacitance of each capacitor in parallel, number of capacitors in operation) can be adjustable. The distance between the electrodes 106, preferably between 0.2 and 5 cm, more preferably between 1 and 3 cm, can also be adjustable. The capacitance of the capacitor 112 can also be adjustable. This makes it possible to have a device suitable for the fracturing of any type of reservoir. In fact, it is not necessary to replace the device when changing the reservoir to be fractured (and when the material is different) as it is sufficient to alter one or more of the adjustable parameters. This also makes it possible to optimize the damage by changing, optionally remotely, the parameters during use.

Figure 11:
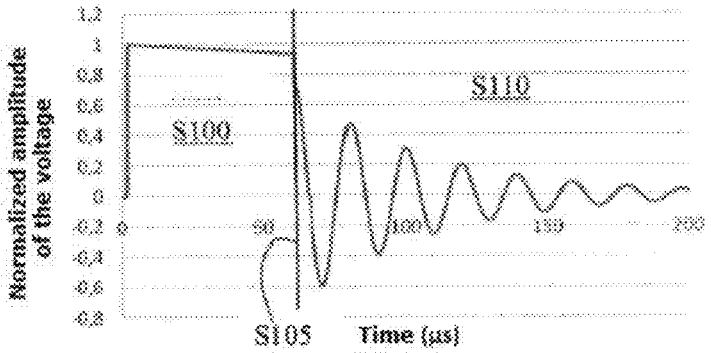
FIGS. 11 to 16, examples of measurements.

The explanations given above will now be illustrated by theoretical developments and tests described with reference to FIGS. 11 to 16 and in particular in relation to the device 100, 130, 140 in FIGS. 8 to 10. With reference to FIG. 11, which shows the normalized amplitude of the voltage at the terminals of the capacitor 112, generation of the pressure wave can be divided into two phases: a pre-discharge phase S100 and a post-discharge phase S110, separated by the appearance S105 of the arc.

During the pre-discharge phase S100, the voltage drops. This voltage drop corresponds to discharge of the equivalent capacitance of the energy bank or of the Marx generator in the equivalent resistance of the device 100. The larger the equivalent resistance, the better the energy conservation in the pre-breakdown phase is. The configuration of the electrodes can therefore, in each case (subsonic or supersonic), make it possible to obtain the least possible energy loss. This corresponds to optimization of heating of the water in one case and of the electric field in the other case.

During the discharge phase S110, the electric circuit can be modelled by an oscillating RLC circuit. The equation for the variation of the current in a series RLC circuit is presented below:

$$i(t) = \frac{U_B}{Lw} \cdot \exp^{-\frac{Rt}{2L}} \cdot \sin(wt) \quad (1)$$

With $$w = \sqrt{\frac{1}{LC} \cdot \left(\frac{R}{2L}\right)^2} \quad (2)$$

Where $U_B$ is the voltage at the moment of dielectric breakdown of water. The parameters L, C and R are respectively the inductance, capacitance and resistance of the circuit. This current i(t) is a function of the breakdown voltage $U_B$ (dielectric breakdown of the medium) of the capacitor, of the inductance and of the resistance of the circuit.

Figure 12:
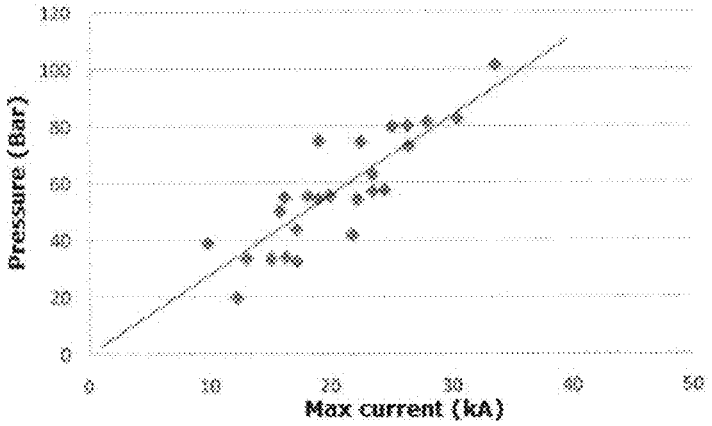
Figure 13:
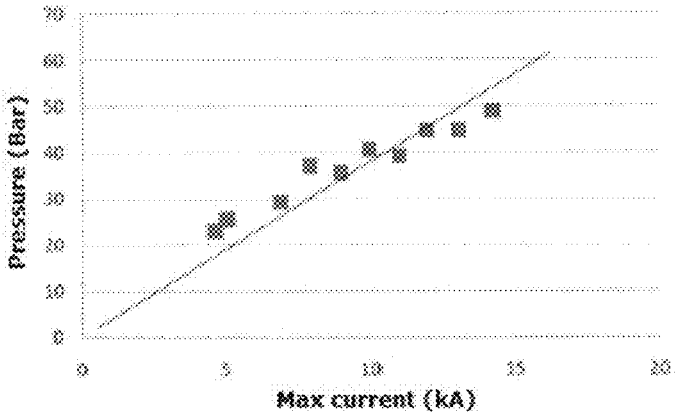
Figure 14:
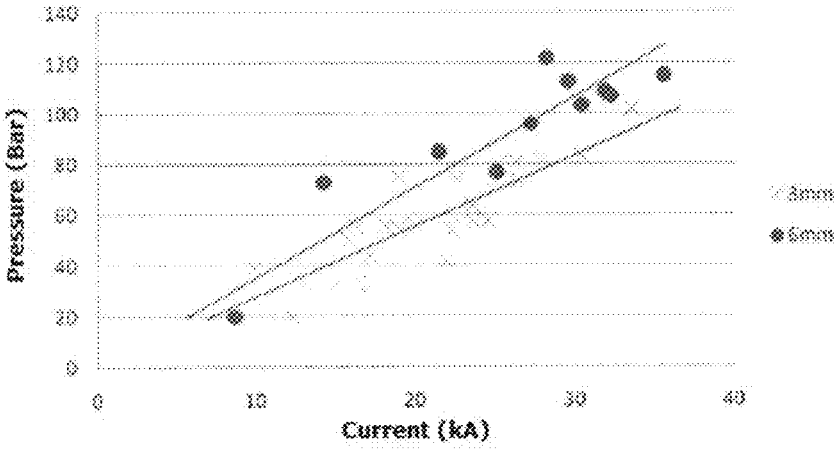

Experiments have demonstrated the linearity of the surge pressure generated as a function of the maximum current at the moment of dielectric breakdown of water in the two breakdown modes. An example of results is shown in FIGS. 12 and 13, showing the measurements obtained for the surge pressure as a function of the maximum current during the discharge phase S110 and the linear regression of the measurements, in subsonic and supersonic mode respectively. It should be noted that the pressure, at similar surge current, is higher for a discharge of the "supersonic" type. This can be explained in part by the processes generating the electric arc in water and the volume of gas between the electric arc and the liquid in the present space between the electrodes.

Additional experiments have demonstrated the influence of the inter-electrode gap on the peak value of the pressure wave generated in the two modes of dielectric breakdown. The length of the electric arc was seen to have a direct influence on the pressure. The larger the inter-electrode gap, the larger the peak value of the pressure seems to be, as shown in the graph in FIG. 14.

Figure 15:
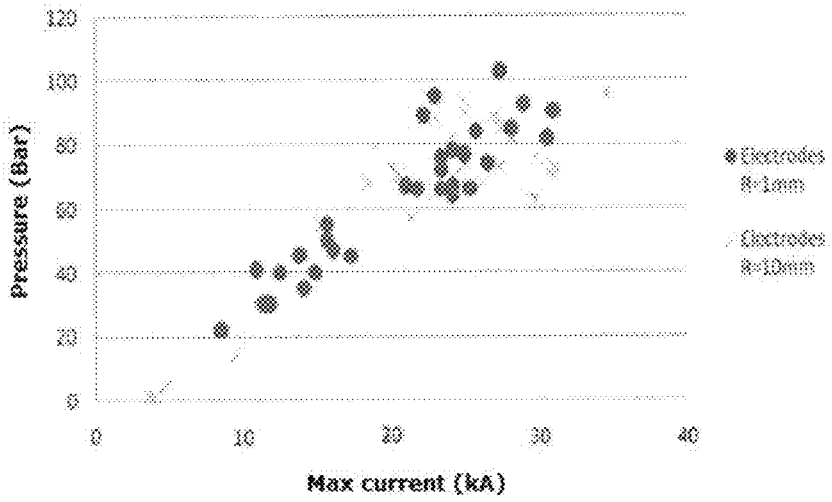

Experiments examined the influence of the geometry of the electrodes with respect to the pressure wave. The results are shown in FIG. 15. It could be concluded from these that the shape of the electrodes used for generating the pressure wave does not seem to have an influence on the peak value of the pressure. It can, however, minimize the electric losses before appearance of the electric arc.

Moreover, a pressure sensor was used in order to visualize the shapes of pressure wave generated as a function of the frequency spectrum. This frequency spectrum can in fact be altered by the manner of dielectric breakdown, by the parameters of the electric circuit, by the volume of gas, and by the nature of the liquid used. Two examples of frequency spectrum associated with a discharge in subsonic and supersonic mode were tested. It was found that the more the spectrum has low frequencies, the less the damage was diffuse.

Figure 16:
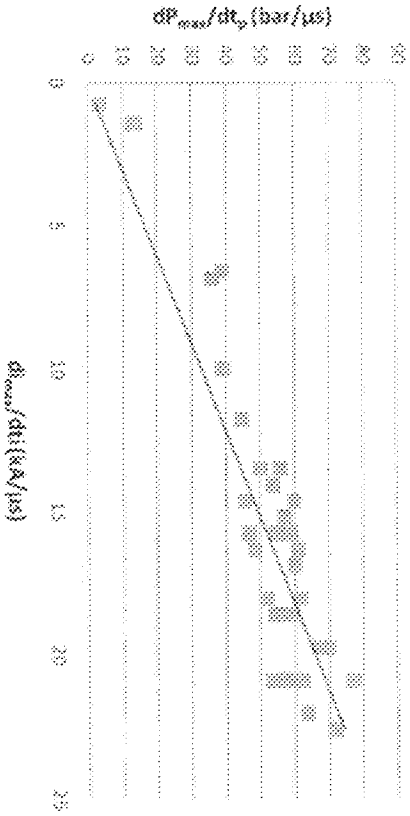

The result of various experiments conducted demonstrates a linear relation of $dP_{max}/dt_p$ as a function of the current front $di_{max}/dt_i$, shown in FIG. 16. The current front has an influence on the pressure front. The slower the current front, the more the pressure is low-frequency. The studies undertaken have moreover clearly demonstrated an effect of the accumulation of damage as a function of the number of shocks. The concept of the recurrence of pulses therefore seems to be a criterion influencing the damage.

Formulating an Equation of the Principles Mentioned Above:

Calculation of the Surge Current Designated $i_{Max}$

In order to calculate the current $i_{max}$, the following conditions are set out:

$$\text{if } \sin(wt) = 1 \text{ and } wt = \frac{\pi}{2}$$

$$\text{then } i(t) = i_{max} \text{ with } t = \frac{\pi}{2w}$$

Using equations (1) and (2):

$$i_{max} = \frac{U_b}{Lw} \cdot \exp^{-\frac{R\pi}{4Lw}} \quad (3)$$

$$T_{front} = \frac{\pi}{2\sqrt{\frac{1}{LC} \cdot \left(\frac{R}{2L}\right)^2}} \quad (4)$$

In the case when the value of w is approximated (value of R very low):

$$w = \sqrt{\frac{1}{LC} \cdot \left(\frac{R}{2L}\right)^2} \approx \frac{1}{\sqrt{LC}} \quad (5)$$

$$i_{max} = U_b \cdot \sqrt{\frac{C}{L}} \cdot \exp^{-\frac{R\pi}{4}\sqrt{\frac{C}{L}}} \quad (6)$$

$$T_{front} \approx \frac{\pi\sqrt{LC}}{2} \quad (7)$$

Energy Relationship $$E_b = \frac{1}{2} \cdot C \cdot U_b^2 \text{ whence } U_b = \sqrt{\frac{2E}{C}} \quad (8)$$

Where $E_b$ is the energy and $U_b$ is the voltage at the moment of the electric arc.

Substituting equation (8) in (3):

$$i_{max} = \sqrt{\frac{2E_b}{L}} \cdot \exp^{-\frac{R\pi}{4}\sqrt{\frac{C}{L}}} \quad (9)$$

The surge current $i_{max}$ is controlled by the energy available at the moment of the arc designated $E_b$ and by the inductance of the circuit L, which are the two parameters on which the user must act. The resistance R is considered to be very low and the capacitance C is a function of the energy $E_b$.

Relationship Between the Surge Pressure and the Maximum Current

Based on the results presented in FIGS. 12, 13 and 15, the following expression can be deduced:

$$P_{max} = k_1 \cdot I_{max} \quad (10)$$

where $k_1$ is a function of the inter-electrode gap and of the breakdown mode

The larger the inter-electrode gap, the larger the coefficient $k_1$ is

Hence:

$$I_{max} = \frac{P_{max}}{k_1} \quad (11)$$

Substituting equation (11) in (9):

$$\frac{P_{max}}{k_1} = \sqrt{\frac{2E_b}{L}} \cdot \exp^{-\frac{R\pi}{4}\sqrt{\frac{C}{L}}} \quad (13)$$

$$P_{max} = k_1\sqrt{\frac{2E_b}{L}} \cdot \exp^{-\frac{R\pi}{4}\sqrt{\frac{C}{L}}} \quad (14)$$

The surge pressure generated is therefore controlled by the current $i_{max}$ (parameters $E_b$ and L) and by the coefficient $k_1$ (which is a function of the inter-electrode gap and of the dielectric breakdown mode of water). $E_b$, L and $k_1$ can therefore be acted upon in order to obtain the desired pressure.

Relationship Between $dP_{Max}/dt_p$ as a Function of $di_{Max}/d_t$

According to FIG. 16, the following expression can be deduced:

$$\frac{dP_{max}}{dt_p} = k_2 \frac{di_{max}}{dt_i} \quad (15)$$

where $k_2$ is a function of the inter-electrode gap and of the breakdown mode

The coefficient $k_2$ corresponds to the electro-acoustic physical coupling.

Using equation (11) and (15):

$$\frac{k_1 di_{max}}{dt_p} = k_2 \frac{di_{max}}{dt_i} \quad (16)$$

$$dt_p = \frac{k_2}{k_1} dt_i \quad (17)$$

$$dt_p = \frac{k_2}{k_1} \frac{\pi\sqrt{LC}}{2} \quad (18)$$

The front of the pressure wave is therefore controlled by the coefficients $k_1$ and $k_2$ and by the values of L and C (parameters of the electric circuit).

Thus, summarizing these studies, it can be noted that:

- In both breakdown modes, the maximum of the pressure wave resulting from the dielectric breakdown of water depends mainly on the value of the maximum current, called $I_{max}$.
- This value of the surge current is a function of the breakdown voltage and of the impedances of the electric circuit. When the configuration of the circuit is imposed, one way of optimizing the current is to increase the breakdown voltage of the gap. This comes down to maximizing the electrical energy switched in the medium.
- When the circuit is not set, but the electrical energy switched is kept constant, the amplitude of the pressure wave is optimized by reducing the impedance of the circuit.
- The form of injection of the current, the dielectric breakdown mode and the nature of the liquid have an influence on the dynamic of the pressure wave. This dynamic and the acoustic efficiency of the device can also be modified by injecting artificial bubbles and by the "double pulse" method (subsonic and supersonic).

At constant current injected, the value of the peak pressure is higher in supersonic mode than in subsonic mode.

At constant current injected, the value of the peak pressure is higher as the inter-electrode gap increases.

The geometry of the electrodes, at constant current injected, does not have an influence on the surge pressure generated, but can play a role in the decrease of the electric losses in the pre-discharge phase.

In conclusion, the above studies confirm the usefulness of inserting an inductance between the voltage source and one of the two electrodes in order to act upon the pressure wave finally generated. The studies also confirm the advantage of having adjustable parameters, e.g. the inductance, the capacitance of the capacitor, the characteristics of the Marx generator. In fact, since the pressure wave depends on these parameters, the possibility of adjusting them makes it possible to control the pressure wave.

Of course, the present invention is not limited to the examples described and illustrated, but can have many variants accessible to a person skilled in the art. For example, the principles presented above can be applied to the production of seismic data. In fact, generation of the electric arc could alternatively induce a pressure wave having characteristics lower than those required for fracturing the reservoir. This can be achieved for example by adapting the charging voltage of the fracturing device and the charging voltage, and by varying the inductance. Such a method for the production of seismic data can then comprise receiving a reflection of the pressure wave, the reflected wave then typically being modulated by its passage through the material constituting the reservoir. The method of production of seismic data can then also comprise analysis of the reflected wave in order to determine characteristics of the reservoir. A seismic survey can then be based on the information received.

The invention claimed is:

1. A device for fracturing a geological hydrocarbon reservoir, the device comprising:

packers defining between them a confined space in a well drilled in the reservoir;

a pump for increasing the pressure of a fluid in the confined space;

an apparatus for heating the fluid;

at least one pair of two electrodes arranged in the confined space; and an electric circuit for generating an electric arc between the two electrodes, the circuit comprising:

at least one voltage source connected to the electrodes and comprising a capacitor;

an inductance coil between the voltage source and one of the two electrodes;

a Marx generator between the capacitor and the inductance coil to generate a supersonic electronic arc between the two electrodes; and ferrites forming a saturable inductance and a spark gap, the ferrites and the spark gap being disposed on a same branch of the circuit and extending parallel to the Marx generator between the capacitor and the inductance coil to generate a subsonic electronic arc between the two electrodes, wherein the circuit is capable of successively generating a supersonic electronic arc and a subsonic electronic arc.

2. The device according to claim 1, wherein the inductance coil is an adjustable inductance coil.

3. The device according to claim 1, wherein the distance between the electrodes is adjustable.

4. The device according to claim 1, wherein the capacitor has a capacitance above 1 μF.

5. The device according to claim 4, wherein the capacitance of the capacitor is adjustable.

6. The device according to claim 1, wherein the electrodes have a radius between 0.1 mm and 50 mm.

7. The device according to claim 1, wherein the device is mobile and is fixed before generating an electric arc.

8. The device according to claim 1, further comprising an uncoupling system.

9. The device according to claim 1, comprising a plurality of pairs of electrodes.

10. The device according to claim 1, wherein the voltage source is able to be charged to a voltage between 1 and 500 kV.

* * * * *